US005918788A

United States Patent [19]

Moorman et al.

[11] Patent Number: 5,918,788

[45] Date of Patent: Jul. 6, 1999

[54] PNEUMATIC FASTENER DRIVING TOOL AND AN ELECTRONIC CONTROL SYSTEM THEREFOR

[75] Inventors: Charles J. Moorman; James J. Diersing; Shin-Leei Hwang, all of Cincinnati, Ohio

[73] Assignee: Senco Products, Inc., Cincinnati, Ohio

[21] Appl. No.: 09/049,168

[22] Filed: Mar. 27, 1998

Related U.S. Application Data

[62] Division of application No. 08/790,009, Jan. 28, 1997, Pat. No. 5,732,870, which is a division of application No. 08/327,279, Oct. 21, 1994, abandoned.

[51] Int. Cl.[6] ..... B25C 1/06

[52] U.S. Cl. ..... 227/8; 227/130

[58] Field of Search ..... 227/8, 130, 131, 227/156

[56] References Cited

U.S. PATENT DOCUMENTS

| | | | |
|---|---|---|---|
| 4,679,719 | 7/1987 | Kramer | 227/131 |
| 4,858,813 | 8/1989 | Wingert | 227/131 |
| 5,069,379 | 12/1991 | Kerrigan | 227/8 |
| 5,605,268 | 2/1997 | Hayashi et al. | 227/131 |

*Primary Examiner*—Scott A. Smith
*Attorney, Agent, or Firm*—Jerrold J. Litzinger

[57] ABSTRACT

An electronically controlled pneumatic fastener driving tool. The tool is of the type having a body containing a cylinder with a piston/driver assembly therein, a firing valve actuable to introduce high pressure air into the cylinder to cycle the piston/driver assembly, a manual trigger, a safety trip, and an electronic control system. The electronic control system comprises a remote solenoid valve to actuate the firing valve, a microprocessor having inputs from at least the trigger and safety trip and an output to energize the solenoid of the remote valve to cycle the tool, a battery to energize the microprocessor and a rechargeable battery to energize the solenoid of the remote valve. The microprocessor determines the mode of operation of the tool and may be designed to provide two or more modes selectable by a mode selection switch. The input from the trigger is provided with a reed switch closable by the trigger and the input from the safety trip is provided with a reed switch closable by the safety trip. The microprocessor may provide a timer to impose a time limit on the trigger, the safety trip, or both. The electronic control system comprises a part of the tool itself. The tool is provided with a generator which partially recharges the solenoid battery during each cycle of the tool.

3 Claims, 8 Drawing Sheets

PNEUMATIC FASTENER DRIVING TOOL AND AN ELECTRONIC CONTROL SYSTEM THEREFOR

CROSS REFERENCE TO RELATED APPLICATIONS

This application is a division application Ser. No. 08/790,009, which was filed Jan. 28, 1997, now U.S. Pat No. 5,732,870 which was a division of application Ser. No. 08/327,279, which was filed Oct. 21, 1994 now abandoned.

TECHNICAL FIELD

The invention relates to an electronically controlled pneumatic fastener driving tool, and more particularly to such a tool having an improved electronic control system, an improved battery powered, solenoid actuated, remote valve, and a generator for partially recharging the solenoid battery each cycle of the tool.

BACKGROUND ART

Many types of pneumatic fastener driving tools are well-known in the art. Those most frequently encountered have a manual trigger and a safety, both of which must be actuated in order to cycle the tool. A workpiece responsive trip is the most usual form of safety. When the trip is pressed against the workpiece, it enables the manual trigger. When the manual trigger is actuated, the tool will cycle. An exemplary tool with a manual trigger and a safety of this type is taught in U.S. Pat. No. 3,278,106.

An "Auto-Fire" mode of operation has heretofore been developed wherein the operator can drive a plurality of fasteners by simply pulling the trigger and moving the fastener driving tool along the workpiece. An example of such a tool is taught in U.S. Pat. No. 3,278,104.

The pneumatic fastener driving art has achieved a high degree of sophistication. It has been found that the more sophisticated pneumatic fastener driving tools have become, the more complex and the more expensive they are.

U.S. Pat. No. 4,679,719, incorporated herein by reference, teaches that if a pneumatic fastener driving tool is provided with an electronic control system, it could be greatly simplified in construction, eliminating complex valving and mechanical linkages. This reference further teaches that a pneumatic fastener driving tool having an electronic control system is more reliable, less expensive to manufacture and more versatile. The control circuit may have a number of input signals, in addition to those provided by the trigger and the trip from various additional devices associated with the tool and indicating various states or conditions of the tool. Finally, the control circuit may be pre-programmed to establish a desired mode of operation of the tool. The control circuit may be so designed that the operator can select one of a number of modes of operation by replacing one control circuit (in the form of a chip or the like) with another. Alternatively, the reference teaches that the control circuit could be preprogrammed in such a way as to enable the operator to select one of a number of modes of operation, by means of a mode selection switch. In any mode of operation, the control circuit interprets the inputs, including their presence or absence and their sequence. When the inputs satisfy the desired mode of operation, the control circuit will generate an output signal to the solenoid controlled remote valve, causing the tool to cycle. The reference finally indicates that the circuit could be so designed as to prevent cycling of the tool if the safety and trigger are not both activated within a predetermined time limit.

The present invention sets forth improvements upon the teachings of U.S. Pat. No. 4,679,719. The present invention teaches an improved electronic control system package mountable directly upon a pneumatic fastener driving tool. The package incorporates reed switches in the inputs from the manual trigger and the safety trip which are actuated by the manual trigger and safety trip, respectively. The tool of the present invention is provided with a solenoid actuated remote valve of novel design and powered by a rechargeable battery having an extended life by virtue of a generator incorporated in the tool in such way as to partially recharge the solenoid battery during each cycle of the tool.

DISCLOSURE OF THE INVENTION

According to the invention there is provided an electronically controlled pneumatic fastener driving tool. The tool is characterized by a body containing a cylinder with a piston/driver assembly therein. A main valve normally closes the top of the cylinder and is actuable to an open position introducing high pressure air into the cylinder to cycle the piston/driver assembly. The fastener driving tool is provided with a magazine supplying fasteners to be driven by the piston/driver assembly, a manual trigger, and a safety trip.

There is an electronic control system associated directly with the tool and comprising a remote solenoid valve to actuate the main valve, a microprocessor having inputs from at least the trigger and the safety trip, and an output to energize the solenoid of the remote valve to cycle the tool. A first battery is provided to energize the microprocessor and a second rechargeable battery is provided to energize the solenoid of the remote valve. A generator is associated with the tool to partially recharge the solenoid battery during each cycle of the tool.

The microprocessor is preprogrammed to determine the mode of operation of the tool. The microprocessor may be so designed as to provide two or more modes of operation for the tool, selectable by the operator through the agency of a mode selection switch, or by other means set forth hereafter.

The input from the manual trigger is enabled by a reed switch closable by the manual trigger, itself. Similarly, the input from the safety trip is enabled by a reed switch closable by the safety trip. The microprocessor may also be preprogrammed to provide a timer to impose a time limit with respect to the trigger, the safety trip, or both.

DETAILED DESCRIPTION OF THE INVENTION

Figure 1:
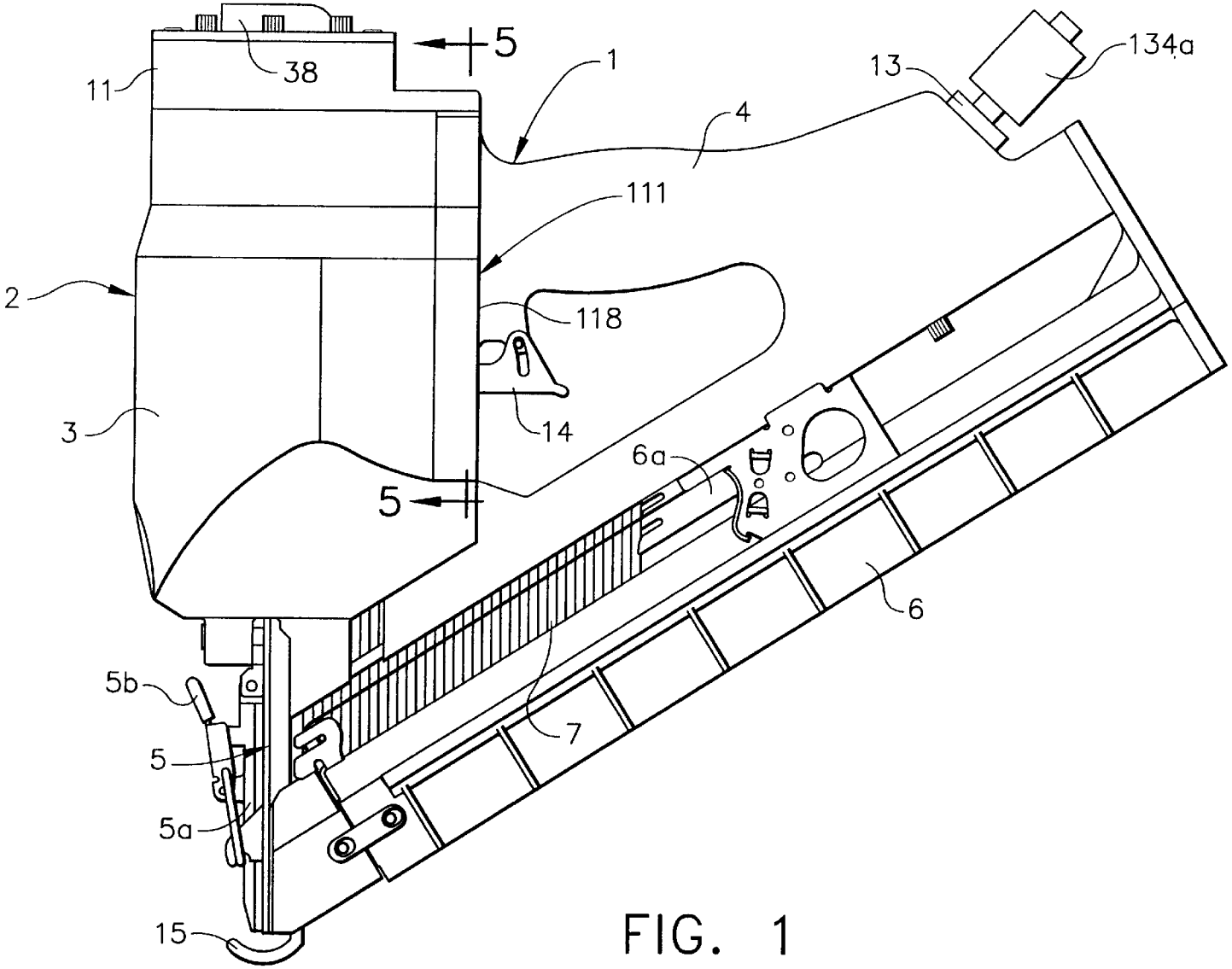
FIG. 1 is a side elevational view of a pneumatic fastener driving tool provided with the electronic control system of the present invention.

Reference is first made to FIG. 1 which constitutes a side elevational view of an exemplary pneumatic fastener driving tool provided with the electronic control system of the present invention. The tool is generally indicated at 1 and comprises a housing generally indicated at 2. The housing has a main portion 3 and a handle portion 4. The housing 2 may constitute an integral, one-piece metallic casting, if desired. Beneath the main body portion 3 of the housing 2 there is a guide body 5 which contains the drive track (not shown) for the tool driver, as is well known in the art. The tool 1 is provided with a magazine 6, affixed to housing 2, and containing a plurality of fasteners 7 in a tandem row. The fasteners may be of any appropriate type including, but not limited to, nails and staples. For purposes of description, the fastener driving tool will be described in terms of a nail driving tool.

The magazine 6 is operatively connected to the drive track within guide body 5. Appropriate means, such as a spring biased shoe 6*a* constantly urges and advances the row of nails 7 such that the forwardmost nail of the row is located within the drive track. The guide body 5 may be provided with a gate 5*a* having a latch mechanism 5*b*. The gate 5*a* provides access to the drive track should a nail become jammed therein.

As will be apparent hereinafter, the main portion 3 of housing 2 has a cylinder 8 therein containing a piston 9 and a fastener driver 10 (see also FIG. 2). As is shown in FIG. 1, the upper end of the main portion 3 of housing 2 is closed by a cap assembly 11.

Figure 2:
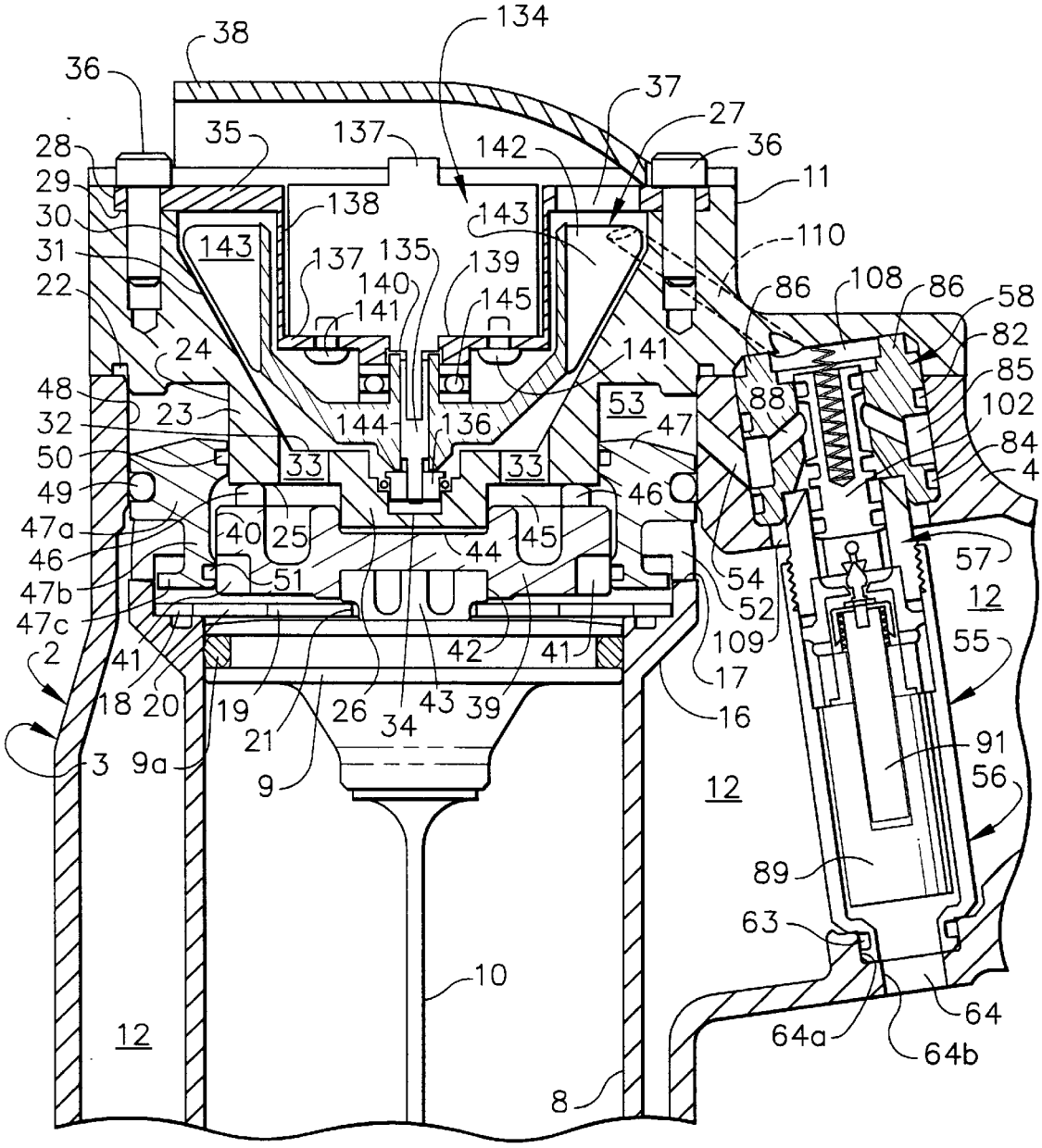
FIG. 2 is a fragmentary cross-sectional view of the tool housing.

The handle portion 4 is hollow, and it, and that part of the main housing portion 3 which surrounds the upper part of cylinder 8 constitute a reservoir 12 for high pressure air (see also FIG. 2). The reservoir 12 is connected to an appropriate source of air under pressure through a line (not shown) having a fitting engageable in the port 13 at the rearward end of the housing handle portion 4.

The tool 1 is provided with a manual trigger 14 and a safety 15 in the form of a workpiece-contacting trip.

Reference is now made to FIG. 2. In this Figure the piston 9 and driver 10 are shown in their uppermost position within cylinder 8. It will be understood by one skilled in the art that the lower end of driver 10 is located in the upper part of the drive track within guide body 5, above the forwardmost nail located therein.

Near its upper end, the cylinder flares outwardly as at 16 and terminates in an uppermost annular surface 17. The upper flared portion 16 of cylinder 8 forms an internal annular shoulder 18. A circular plate 19 is mounted on shoulder 18. The plate 19 has a number of openings 20 formed therein for air to enter and leave the interior of cylinder 8. The plate 19 has a central opening 21, the purpose of which will be apparent hereinafter.

The cap assembly 11 is affixed to the upper end of the main portion 3 of tool housing 2 by machine screws or the like (now shown). The cap assembly is sealed to the upper end of the main portion 3 of tool housing 2 by O-ring 22. The cap assembly 11 has a downwardly depending cylindrical portion 23 providing a vertical cylindrical surface 24. The cylindrical surface 24 terminates in a horizontal annular surface 25 provided with a lowermost cylindrical protrusion 26.

The cap assembly 11 is provided with a central chamber, generally indicated at 27. The chamber 27 is defined by a first cylindrical surface 28 followed by an annular horizontal shoulder 29. The shoulder 29 is followed by a second cylindrical surface 30 leading to a downwardly and inwardly sloping surface 31. The sloping surface 31 terminates in an annular horizontal surface 32 parallel to the surface 25. A plurality of ports 33 are formed between the surfaces 32 and 25. Finally, the horizontal annular surface 32 leads to a bore 34 extending downwardly into the cap cylindrical protrusion 26. The chamber 27 is provided at its upper end with a plate-like closure 35. The peripheral portion of the closure 35 rests upon the cap assembly shoulder 29 and is affixed thereto by a plurality of machine screws, two of which are shown at 36. The closure 35 is provided with a plurality of perforations therethrough, one of which is shown at 37, so that the chamber 27 is open to atmosphere. The closure 35 may have affixed thereto a shield 38 so that exhaust air from perforations 37 can be directed forwardly of the tool and away from the operator.

Between the cap assembly 11 and the plate 19, at the upper end of cylinder 8, there is a circular disk-like member 39 having a vertical cylindrical peripheral surface 40. The lower portion of the surface 40 has a plurality of notches 41 formed therein about the periphery of member 39. The member 39 has on its bottom surface a central depression 42 adapted to receive a bumper 43 made of resilient material. The bumper 43 extends through the central perforation 21 of plate 19 and contacts piston 9. The bumper 43 serves to arrest the upward movement of the piston at the end its return stroke. In a similar fashion, the upper surface of member 39 has a central depression 44 adapted to receive the cylindrical protrusion 26 of cap assembly 11. The member 39 is completed by the provision of a series of segments of a spacer rim 45 which abut the annular surface 25 of cap assembly 11. The fact that the spacer rim 45 is segmented provides a plurality of air passages, two of which are shown at 46.

The main valve assembly is indicated at 47 in its closed position in FIG. 2. The main valve assembly 47 comprises an annular member adapted to shift vertically between the adjacent inner surface 48 of housing main portion 3 and the vertical cylindrical cap assembly surface 24 and the vertical cylindrical surface 40 of member 39. The main valve assembly 47 has an upper enlarged portion 47*a*, a downwardly depending skirt portion 47*b*, and a lower enlarged portion 47*c*. The upper enlarged portion 47*a* carries an O-ring 49 contacting the inside surface 48 of housing main portion 3. The upper enlarged portion 47*a* also carries an O-ring 50 making a seal with the vertical cylindrical surface 24 of cap assembly 11. The lower enlarged portion 47*c* of main valve assembly 47 carries an O-ring 51 capable of sealingly engaging the vertical, cylindrical, peripheral surface 40 of member 39. Finally, the skirt portion 47*b* of main valve assembly 47 carries a sealing ring 52 of inverted L-shaped cross-section. The sealing ring 52 is slidable on the skirt portion 47*b* between the upper enlarged portion 47*a* and the lower enlarged portion 47*c* of the main valve assembly 47, for reasons which will become apparent hereinafter.

When the main valve assembly 47 is in its closed position as shown in FIG. 2, the O-ring 49 is in sealing contact with the inside surface 48 of housing main portion 3; O-ring 50 is in sealing contact with vertical, cylindrical cap assembly surface 24; and O-ring 51 is out of sealing contact with the cylindrical peripheral surface 40 of member 39, by virtue of the notches 41. The sealing ring 52 is shifted to its uppermost position on main valve assembly skirt portion 47*b* and is in sealing engagement with the upper end 17 of cylinder 8, closing the cylinder with respect to air under pressure within reservoir 12.

The piston 9 is sealingly engaged with the inside surface of cylinder 8 by means of O-ring 9*a*. When the main valve assembly 47 is in its closed position, it will be noted that that portion of the cylinder 8 above piston 9 is vented to atmosphere through the openings 20 in plate 19, the notches 41 in member 39, the passages 46 of segmented rim 45, the passages 33 in cap assembly 11 and the perforations 37 in closure 35.

The main valve assembly 47 is normally maintained in its closed position (as shown in FIG. 2) by air under pressure in the space or volume 53 above the enlarge upper portion 47*a* of main valve assembly 47. The volume 53 is connected to a passage 54. The passage 54 is connectable to reservoir 12 by remote valve 55, to be described hereinafter.

When the passage 54 is opened by remote valve 55 to reservoir 12, the main valve assembly 47 is acted upon by high pressure air from above (volume 53) and from below (reservoir 12). The area of the main valve assembly 47 operated upon by air under pressure in volume 53 is far greater than the area of the main valve assembly 47 exposed to air under pressure directly from reservoir 12, so that the main valve assembly 47 is biased to its closed position so long as the passage 54 is connected to air under pressure from reservoir 12.

To cause the tool to cycle, the remote valve 55 is actuated to connect the passage 54 to atmosphere. Under these circumstances, air under pressure operating on the main valve assembly 47 directly from reservoir 12 can now cause the main valve assembly to shift upwardly to its open position. This same air will initially tend to maintain sealing ring 52 seated against the upper end 17 of cylinder 8 while the main valve assembly 47 shifts upwardly. As a result of this, the main valve assembly O-ring 51 will come into sealing contact with the vertical, cylindrical surface 40 of member 39 above notches 41, thereby sealing off the above-described vent passages to atmosphere prior to the opening of cylinder 8. Additional upward movement of the main valve assembly 47 results in a lifting of sealing ring 52 from the upper end 17 of cylinder 8 by the enlarged lower portion 47*c* of the main valve assembly 47. At this point, the piston 9 is exposed to air under pressure from reservoir 12 and is driven rapidly and with considerable force downwardly to drive the fastener within the drive track of guide body 5 into a workpiece.

Upon disconnection of passage 54 from atmosphere and reconnection of passage 54 to reservoir 12 by remote valve 55, the greater effective surface are of the upper portion 47*a* of main valve assembly 47 will result in downward movement of the main valve assembly 47. Sealing ring 52 is in its lowermost position with respect to the main valve assembly skirt 47*b*, and will first contact the upper edge 17 of cylinder 8, closing the cylinder 8. Further downward movement of the main valve assembly 47 will cause the O-ring 51 to move downwardly into the area of the notches 41, thus venting that portion of cylinder 8 above piston 9 to atmosphere through notches 41, rim passages 46, passages 33 of cap assembly 11 and the perforations 37 of closure 35.

Prior art workers have devised a number of ways to return the piston 9 to its uppermost position, and the manner in which this is accomplished does not constitute a limitation on the present invention. For example, a return air reservoir (not shown) may be provided which is charged with air under pressure from the reservoir 12 when the piston achieves its fully driven position. Air from the return air reservoir raises the piston 9 when the main valve assembly 47 is in its closed position and the area above piston 9 is vented to atmosphere in the manner indicated above.

As described heretofore, the main valve assembly 47 is actuated by remote valve 55. The toot cycle sequence begins when the remote valve 55 connects passage 54 to atmosphere. Closure of main valve assembly 47 is accomplished when remote valve 55 connects passage 54 to reservoir 12. The remote valve 55 is shown in its normal, unactuated condition in FIG. 3. Remote valve 55 is a part of the control system of the present invention and comprises a two stage, solenoid actuated, pilot valve. Remote valve 55 is made up of a lower valve housing generally indicated at 56, and intermediate valve housing generally indicated at 57 and an upper valve housing generally indicated at 58.

The lower valve housing 56 of remote valve 55 comprises an elongated cylindrical member having an upper end 59 and a lower end 60. From the upper end 59 toward the lower end 60, the lower valve housing 56 has a constant outer diameter for the majority of its length. Near its lower end 60, the lower valve housing 56 has a short portion of lesser diameter 61 provided with an annular notch 62 adapted to receive an O-ring 63. As will be apparent from FIG. 2, the tool housing 2 has a bore 64 formed therethrough with upper and lower portions 64*a* and 64*b*, the upper portion 64*a* being of larger diameter than the lower portion. The upper portion 64*a* is of a diameter to just nicely receive the portion 61 of lower valve housing 56, with O-ring 63 making a seal therebetween.

Lower valve housing 56 has an axial bore 65 having an upper portion 65*a*, an intermediate portion 65*b* of lesser diameter, and a lower portion 65*c* of smaller diameter than the portion 65*b*. Between bore portions 65*a* and 65*b* there is formed an annular shoulder 66, the purpose of which will be apparent hereinafter. It will be noted that the uppermost part of bore portion 65*a* is internally threaded as at 67.

The intermediate valve housing 57 comprises a cylindrical member, the lower half of which is externally threaded as at 68. The intermediate housing 57 has an upper annular end 69 and a lower annular end 70. The upper annular end 69 of intermediate valve housing 57 has a plurality of upwardly and inwardly sloping notches 71 formed therein, the purpose of which will be apparent hereinafter. The intermediate valve housing 57 is provided with an upper axial blind bore 72 and a lower axial blind bore 73 of slightly greater diameter. The web 74 between blind bores 72 and 73 is provided with a series of vertical passages 75, connecting blind bores 72 and 73. Web 74 is also provided with a transverse bore 76 which extends all the way through intermediate valve housing 57 and communicates with reservoir 12 at both of its ends. The transverse bore 76 is connected by a vertical axial bore 77 to an enlarged bore 78, the sides of which slope downwardly and inwardly. An O-ring 79 is located in bore 78 and forms a resilient valve seat.

The upper valve housing 58 comprises a member having a vertical, cylindrical, exterior surface 80. The surface 80 has an upper annular notch 81 to support O-ring 82 and a lower annular notch 83 to support O-ring 84. Between notches 81 and 83, there is an enlarged annular notch 85, constituting an annular air passage, as will be apparent hereinafter.

At its upper end, upper valve housing 58 has a plurality of spacer lugs arranged thereabout. In the Figures, only two of the spacer lugs are shown for purposes of clarity at 86.

Upper valve housing 58 has an axial bore of complex shape, generally indicated at 87. The bore 87 has a first portion 87*a*, a second portion 87*b* of lesser diameter, a downwardly and outwardly sloping portion 87*c* and a larger diameter portion 87*d*. An annular shoulder 87*e* is formed between bore portions 87*c* and 87*d*. It will be noted that the portion 87*b* of axial bore 87 is connected to large annular notch or air passage 85 by a plurality of bores, two of which are shown at 88.

Within lower valve housing 56 there is a cylindrical solenoid coil assembly 89 having a large diameter portion 89*a* and an upper portion 89*b* of lesser diameter, forming a shoulder 89*c* therebetween. The portion 89*b* of solenoid coil assembly 89 is externally threaded as at 90. The solenoid coil assembly 89 has a blind axial bore 91 extending through portion 89*b* and into the large diameter portion 89*a*. The blind bore 91 receives a solenoid rod 92, which is axially shiftable therein. A valve plunger 93 passes through a washer 94, a cap-like spring retainer 95, and is affixed by threading or other appropriate means to the upper end of the solenoid rod 92. A spring 96 is located about the upper end of solenoid rod 92. One end of the spring abuts spring retainer 95, and the other end of the spring abuts the upper end of small diameter portion 89*b* of solenoid coil assembly 89. As a result, the valve plunger 93 is constantly urged toward its most extended position (shown in FIG. 3) by compression spring 96.

Located within lower valve housing 56 there is a solenoid housing 97. Solenoid housing 97 is of cylindrical exterior configuration and has an upper portion 97*a* which is just nicely received in the blind bore 73 of intermediate valve housing 57. The solenoid housing 97 has lower portion 97*b* of enlarged diameter which is just nicely received in the bore portion 65*a* of lower valve housing 56, the solenoid housing portion 97*b* resting upon the annular interior shoulder 66 of lower housing 56. The upper portion 97*a* of solenoid housing 97 and the lower portion 97*b* thereof form therebetween an annular shoulder 97*c*. Solenoid housing 97 is held in place within lower valve housing 56 and against annular shoulder 66 thereof by the intermediate valve housing 57 when threadedly engaged in the lower valve housing 56, is clearly shown in FIG. 3. An O-ring 98 is located between the lower end 70 of intermediate valve housing 57 and the annular shoulder 97*c* of solenoid housing 97. It will be noted in FIG. 3 that the smaller diameter portion 97*a* of solenoid housing 97 abuts the web 74 of intermediate valve housing 57.

The solenoid housing 97 has an axial bore 99 which extends upwardly from the lowermost end of solenoid housing 97. The lower portion of bore 99 is threaded and the upper portion 89*b* of the solenoid coil assembly is threadedly engaged therein. The bore 99 terminates in an upwardly and outwardly flaring bore 100 which serves as a second seat for solenoid plunger 93, as will be explained hereinafter. The outwardly flaring bore 97, in turn, leads to a dish-shaped bore 101 which communicates with bores 75 and 78 of intermediate housing 57.

Remote valve 55 is completed by a valve spool 102 of cylindrical peripheral configuration having an upper enlarged cylindrical portion 102*a*, an intermediate enlarged cylindrical portion 102*b*, and a lower enlarged cylindrical portion 102*c*. Enlarged portions 102*a*, 102*b* and 102*c* are provided with notches receiving O-rings 103, 104 and 105, respectively. The valve spool 102 is provided with an axial blind bore 106 which contains a compression spring 107. One end of compression spring 107 abuts the blind end of bore 106. The other end of compression spring 107 abuts the inside surface of the tool cap assembly 11, as is shown in FIG. 2. The spring normally urges the lowermost end of valve spool 102 into abutment with the web 74 of intermediate housing 57.

As was described heretofore, the lower end of remote valve 55 is mounted in the large diameter portion 64*a* of housing bore 64 and is sealed therein by O-ring 63, as is clearly shown in FIG. 2. The housing 2 of tool 1 and the cap assembly 11, together, have a circular chamber 108 formed therein. The chamber 108 is connected by an opening 109 to reservoir 12. As is most clearly shown in FIG. 2, the upper valve housing is just nicely received within chamber 108 with upper valve housing O-rings 82 and 84 forming a seal with the chamber sidewall above and below the enlarged annular notch or air passage 85. Spacer lugs 86 abut cap assembly 11. The space 109 in cap assembly 11 is connected to chamber 27 of cap assembly 11 and thus to atmosphere by outlet port 110, shown in FIG. 2. It will be noted that the lower end of lower valve body 56 of remote valve 55 is connected to atmosphere through the small diameter portion 64*b* of bore 64. Finally, it should be noted that the axial bore 87 of upper valve housing 58 is connected to the passage 54 by means of bores 88 and the annular enlarged notch or air passage 85.

Figure 3:
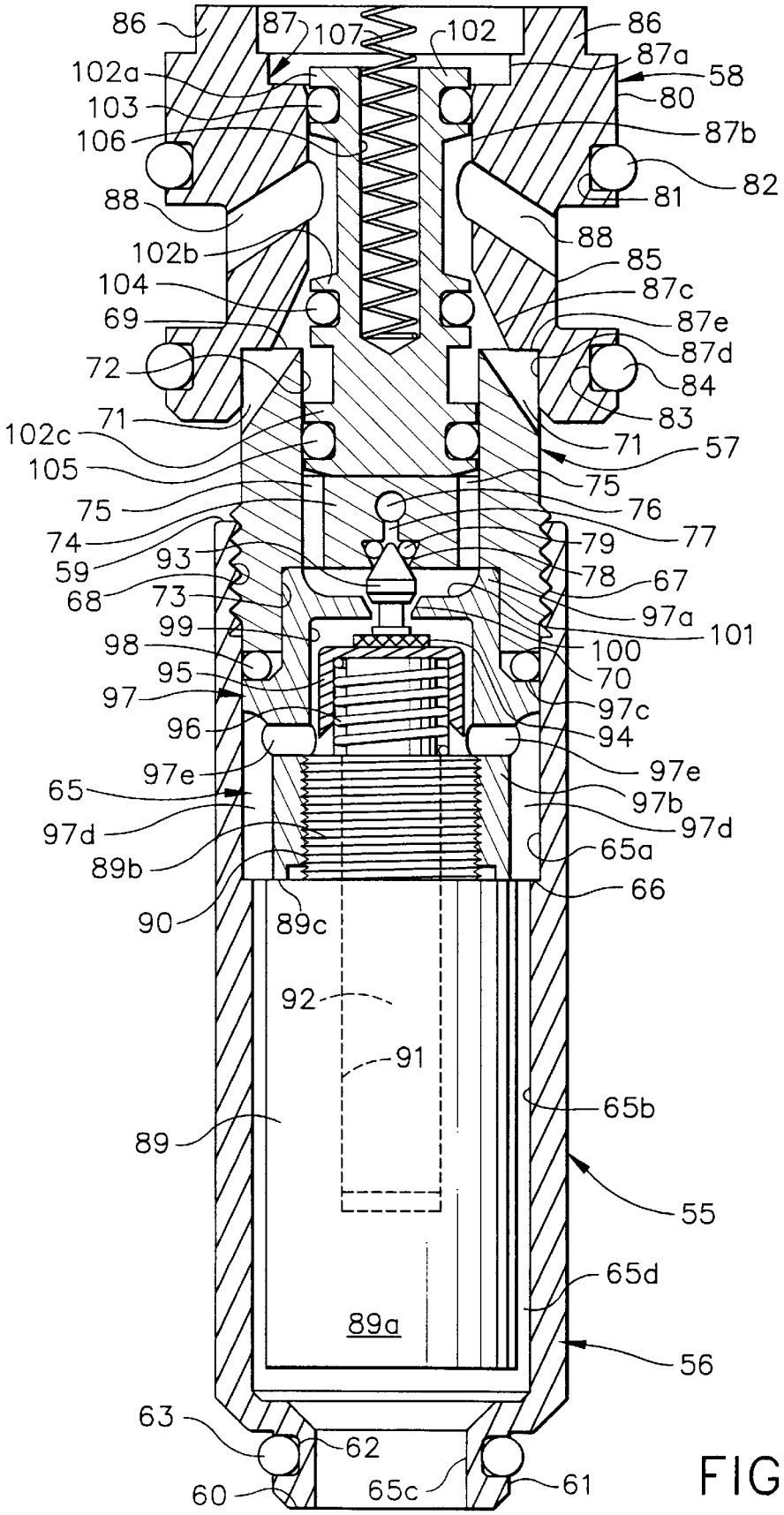
FIG. 3 is a longitudinal cross-sectional view of the solenoid actuated pilot valve of the present invention in its normal, unactuated position.

In FIGS. 2 and 3 the remote valve 55 is shown in its normal, unactuated state. In the normal, unactuated state, the solenoid coil is de-energized and the solenoid rod is urged to its uppermost position by compression spring 96. When the solenoid rod 92 is in its uppermost position, the solenoid plunger engages O-ring 79 closing the passage 77 leading to transverse passage 76. Since transverse passage 76 extends completely through intermediate valve housing 57, it is constantly connected to high pressure air in reservoir 12, as indicated above.

The lower large diameter portion 97*b* of the solenoid housing 97 has formed in its peripheral surface a series of groove-like passages, two of which are shown at 97*d*. At their upper ends, the passages 97*d* are connected to the axial bore 99 of solenoid housing 97 by radial passages 97*e*. The lower ends of groove-like passages 97*d* communicate with an annular passage 65*d* formed between the inner cylindrical surface of bore 65*b* of lower valve housing 56 and the peripheral surface of the solenoid coil assembly 89. The annular passage 65*d*, in turn, leads to the opening 65*c* at the bottom 60 of lower valve housing 56.

When the valve plunger 93 is in its normal position as shown in FIG. 3 the bottom surface of annular enlarged portion 102*c* of the valve spool is subject to ambient air via passages 75 of intermediate valve housing 57, bores 101, 100 and 99 together with passages 97*e* and 97*d* of the solenoid housing, the annular passage 65*d* between the solenoid coil assembly 89 and the interior surface 65*b* of the lower valve housing 56 and lowermost bore 65*c*. High pressure air from the reservoir 12 passes into the upper valve housing 58 through the notches 71 formed in the upper end of intermediate valve housing 57. The high pressure air is prevented from entering the passages 75 of intermediate valve housing 57 by spool O-ring 105. Similarly, spool O-ring 103 prevents the high pressure air from existing to exhaust or atmosphere. The high pressure air, therefore, enters the space or volume 53 above main valve assembly 47 via bores 88, annular enlarged groove 85 and passage 54. As a consequence, the main valve assembly 47 remains in its closed, unactuated position. This passage of high pressure air from reservoir 12 to the space or volume 53 above main valve assembly 47 is enabled by the position of spool 102. It has been stated that the annular lower surface of the lower annular enlarged spool portion 102*c* is exposed to atmosphere. The upper surface of lower annular enlarged spool portion 102*c* is exposed to high pressure air, as is both the upper and lower annular surfaces of the intermediate enlarged spool portion 102*b* and the lower annular surface of the upper enlarged spool portion 102*a*. The upper annular surface of the enlarged upper spool portion 102*a* is, of course, subjected to ambient air via exhaust passage 110 (see FIG. 2). The various annular surfaces of the enlarged portions 102*a*, 102*b* and 102*c* of the spool 102 are so configured and sized that the ultimate affect of the high pressure air entering through slots 71 is to urge the spool downwardly to the position shown, further assisted by compression spring 107.

Figure 4:
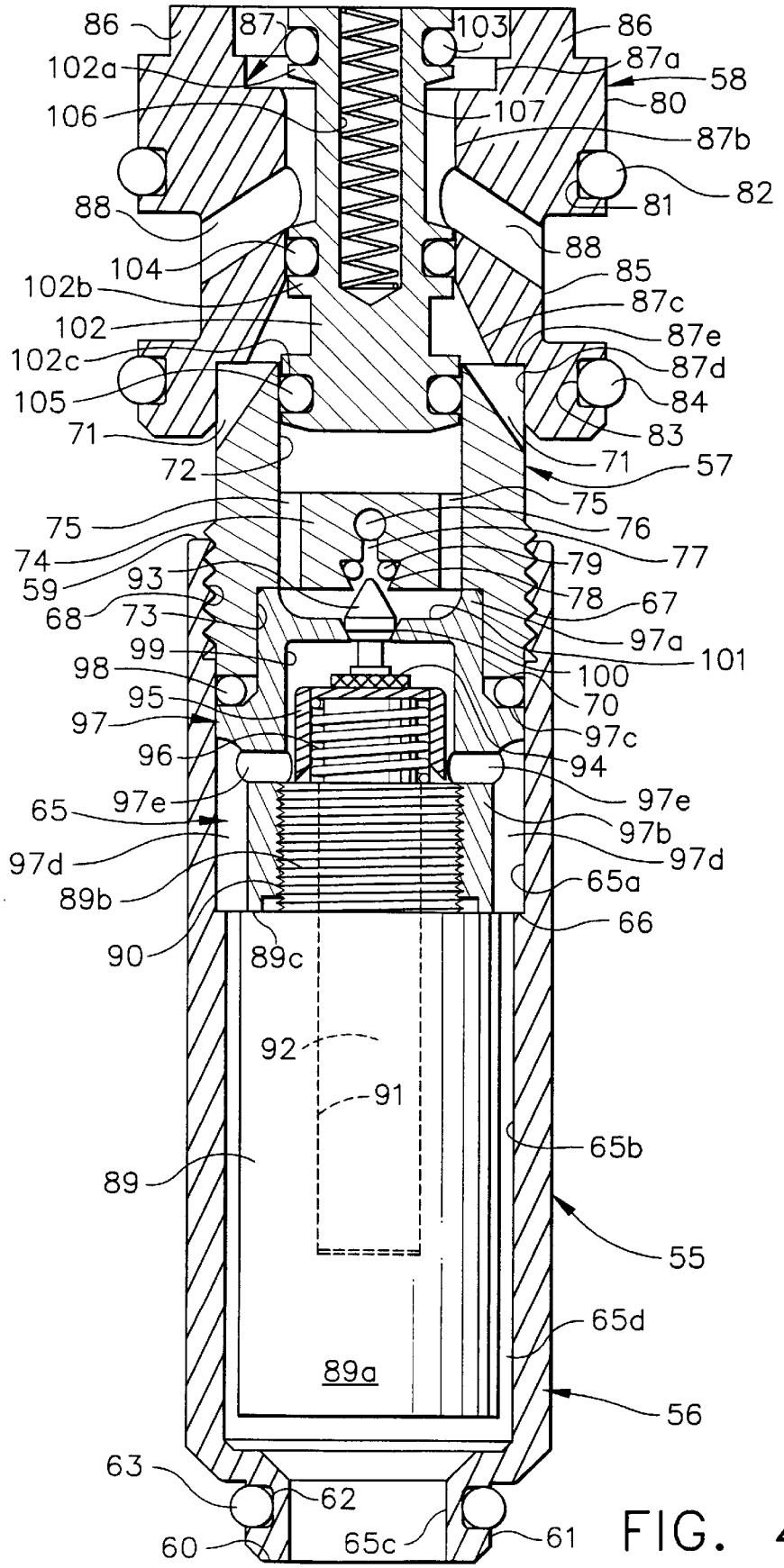
FIG. 4 is a longitudinal cross-sectional view of the solenoid actuated pilot valve of FIG. 3 illustrating the valve in its actuated position.

The remote valve 55 is a two stage valve having a normal unactuated state illustrated in FIG. 3 and an actuated state illustrated in FIG. 4. In its actuated state, the solenoid coil assembly 89 is energized, drawing the solenoid valve rod 92 downwardly into the axial bore 91 of the solenoid coil assembly 89, against the action of compression spring 96. In this position, the solenoid plunger 93 closes the downwardly and inwardly sloping bore 100 so that the bowl-like bore 101 is no longer connected to atmosphere. Since the bore 78 is now open by virtue of the downward movement of the valve plunger 93, high pressure air passes through bore 78 from bores 76 and 77. The high pressure air entering the bowl-shaped bore 101 passes upwardly through the bores 75 of intermediate valve housing 57. As a result, high pressure air operates on the entire bottom surface of spool 102. This is sufficient to cause the upward shifting of spool 102 against the action of compression spring 107. When the spool 102 is in the position shown in FIG. 4, O-ring 105 remains sealed to the inner surface of blind bore 72 of the intermediate valve housing. At this stage, however, O-ring 104 sealingly engages the inner surface of bore portion 87*b* of upper valve housing 58, effectively sealing bores 88, enlarged annular notch 85, passage 54 (see FIG. 2) and space or volume 53 over main valve assembly 47 from the high pressure air of reservoir 12. Furthermore, spool O-ring 103 no longer sealingly engages bore portion 87*b* of upper valve housing 58 so that the space or volume 53 above the main valve assembly 47 is directly connected to atmosphere via passage 54, enlarged annular groove 85, bores 88, axial spool bore portion 87*b*, the space 109 shown in FIG. 2 and exhaust passage 110 shown in FIG. 2.

When the solenoid coil assembly 89 is de-energized, remote valve 55 will return to its normal state, as illustrated in FIG. 3. The space or volume 53 will once again be filled with high pressure air from reservoir 12 and the main valve assembly 47 will return to its closed position. The piston 9 and driver 10 will return to their unactuated positions, and the air above the piston will pass to exhaust as described heretofore.

Figure 5:
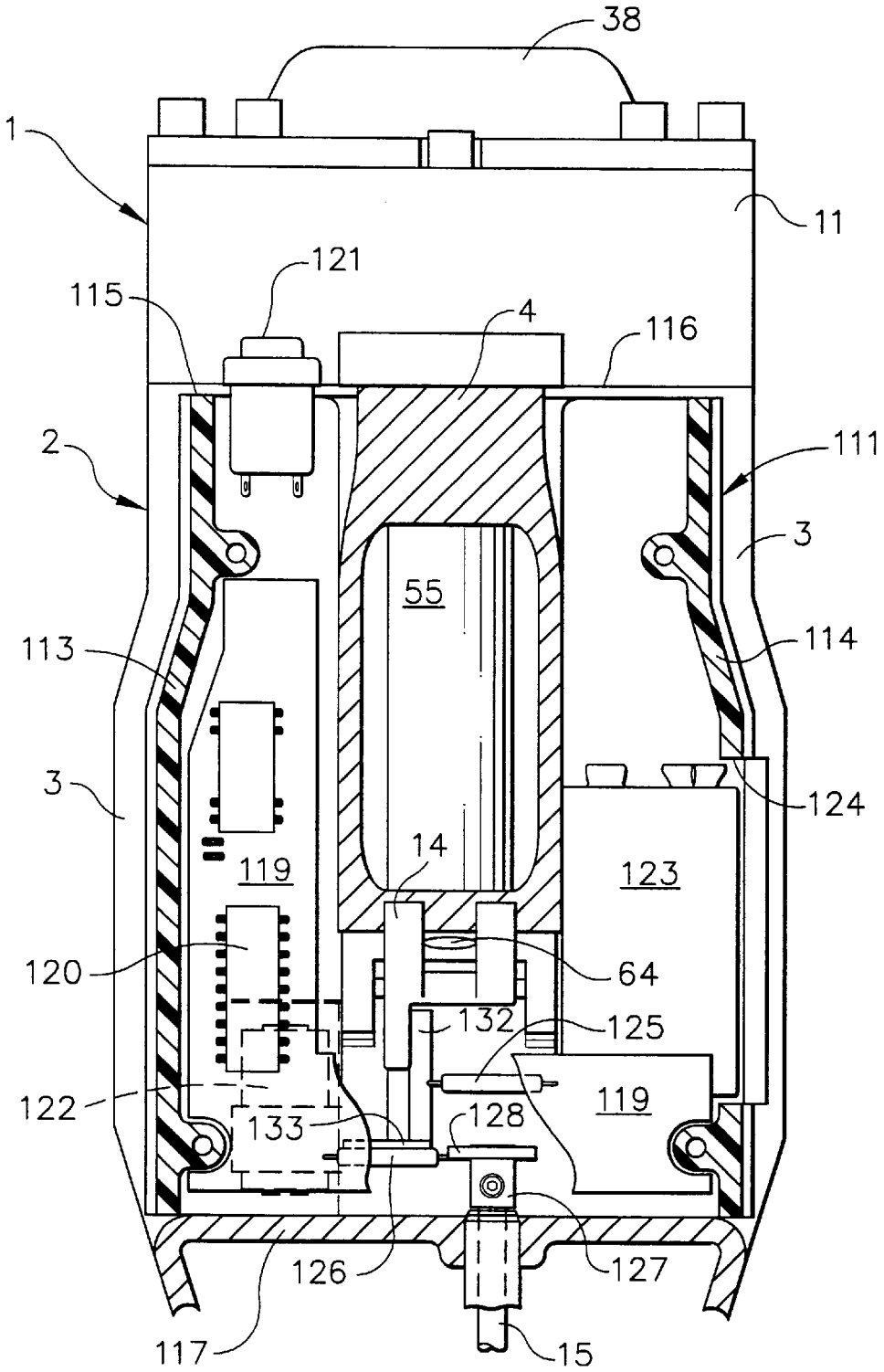
FIG. 5 is an elevational cross-sectional view of the electronics package taken along section line 5—5 of FIG. 1.

The control system of the present invention further includes an electronics package next to be described. Reference is made to FIGS. 1 and 5 wherein the electronics package is most clearly shown. FIG. 5 is a cross-sectional view taken along section line 5—5 of FIG. 1. The electronics package is generally indicated at 111. The electronics package is located adjacent the rear of the main portion 3 of housing 2, as shown in FIG. 1. The package 111 extends beneath and upwardly to either side of the handle portion 4 of tool housing 2. The forward wall of the package consists of surfaces of the rearward portion of housing part 3. The same is true of the top of the package as at 115 and 116 in FIG. 5. The rearward part of housing portion 3 further provides the bottom wall 117 of package 111. A U-shaped rear plastic panel 118 (see FIG. 1) forms the back of the package 111. The package has sides 113 and 114 which, with rear panel 118, may constitute an integral, one-piece plastic molding. The interior vertical walls of the package 111 are provided by the handle portion 4 of housing 2, as shown in FIG. 5.

Within the electronics package 111, there is fragmentarily shown an L-shaped circuit board 119. The circuit board 119 represents the control circuit of the present invention which is not shown in detail since it can be implemented in various ways, well known to those skilled in the art. The control circuit represented by circuit panel 119 does include a microprocessor 120. The microprocessor not only actuates the solenoid coil assembly 89 of remote valve 55, but also determines the mode of operation of the tool 1. The microprocessor 120 can also be designed to operate the tool in two or more modes, selectable by a mode selector switch 121 having a number of positions equal to the number of modes provided by microprocessor 120. In the preferred embodiment of the tool 1 of the present invention, the tool is self-contained and the electronics package includes a six volt battery 122 to operate the microprocessor 120. The electronics package 111 also includes a nine volt battery 123 to energize the solenoid coil assembly 89 of remote valve 55. The nine volt battery 123 is preferably rechargeable, as will be further discussed hereinafter. The sidewall 114 of electronics package 111 may be provided with an opening 124 for access to battery 123 for replacement. The opening 124 may be closed by a snap-on door (not shown), or the like.

The microprocessor 120 has at least two inputs. One input is represented by and activated by a switch 125 which is closed by the workpiece responsive trip 15, when it is pressed against a workpiece and shifted to its actuated position. The second microprocessor input is represented and actuated by switch 126 which is closed when manual trigger 14 is shifted to its actuated position. The switches 125 and 126 are preferably reed switches, each enclosed in a glass tube, as is well known. Such switches are preferred by virtue of the fact that they are small, reliable, subject to minimal wear, and are environmentally protected.

Figure 6:
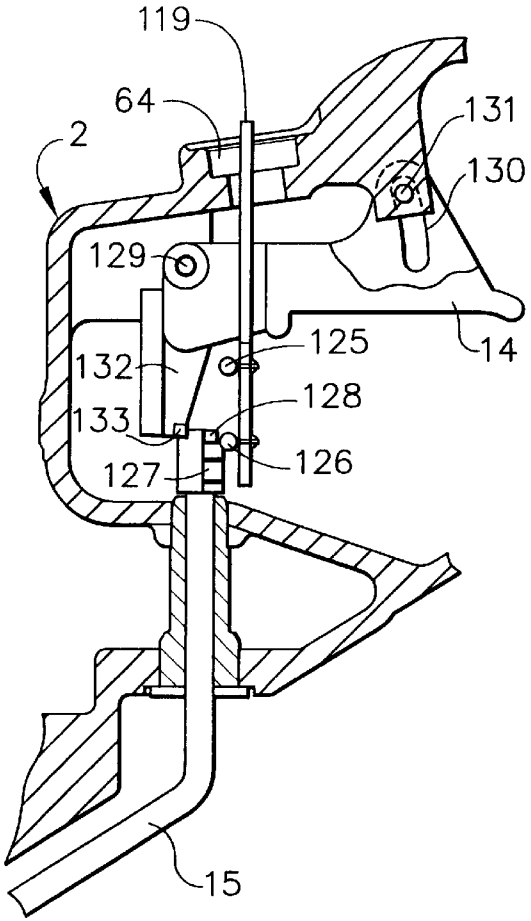
FIG. 6 is a simplified representation showing the trigger and the workpiece contacting trip in their unactuated positions.

Reference is made to FIG. 6 which is a simplified, fragmentary view of the trigger 14 and trip 15 in their normal, unactuated positions. FIG. 3 also illustrates the circuit board 119, the trip actuated switch 125 and the trigger actuated switch 126. As is well known, the trip 15 is biased to its lowermost unactuated position shown in FIGS. 1 and 6 by compression springs (not shown) or other means well known in the art. In this embodiment, the uppermost end of trip 15 is provided with a fitting 127 supporting a small bar magnet 128. As is evident from FIG. 5, the trigger actuated switch 126 and the trip actuated switch 125 are offset laterally with respect to each other. In FIG. 6, the magnet 128 of the workpiece responsive trip 15 is remote from reed switch 125 and the reed switch 125 will be in its normal open state.

In FIG. 6, the manual trigger 14 is shown in its unactuated position. The trigger 14 is pivoted as at 129. The trigger 14 may be provided with a slot 130 adapted to receive a pin 131 mounted on the tool housing 2. The unactuated position of trigger 14 is determined by the pin 131 within slot 130 as shown in FIG. 3. At its pivoted end, the trigger 14 is provided with an extension 132. The extension 132 supports a bar like magnet 133. Since the trigger 14 is shown in FIG. 6 in its unactuated position, the magnet 133 is remote from the trigger actuated reed switch 126, and the reed switch 126 will be in its normal open state.

Figure 7:
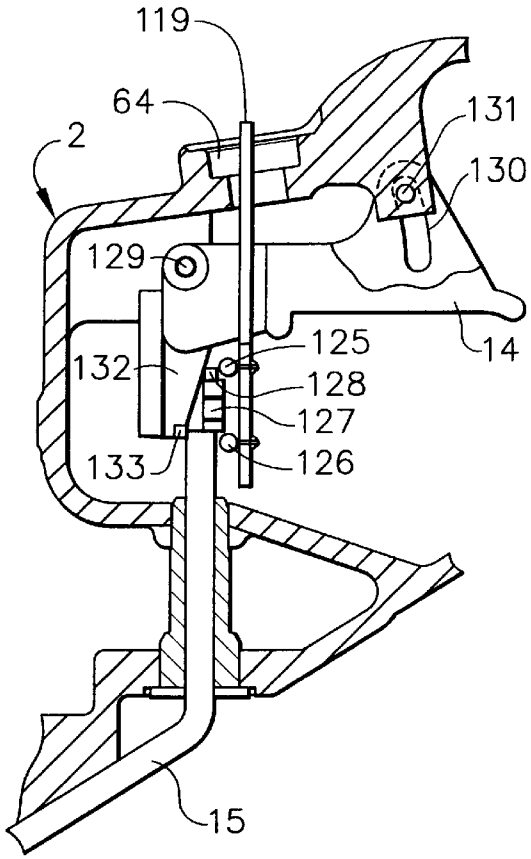
FIG. 7 is a simplified representation similar to FIG. 6 illustrating the workpiece-responsive trip in its actuated position.

FIG. 7 is similar to FIG. 3, differing only in that it shows the workpiece responsive trip 15 in its actuated position. Since the workpiece-responsive trip 15 is in its fully actuated position, magnet 127 is located adjacent the workpiece-responsive trip actuated reed switch 125. As a result, the reed switch 125 will assume its closed and actuated position. When the workpiece responsive trip 15 is lifted from the workpiece, it will return to its normal, unactuated position shown in FIG. 3 and switch 125 will assume its open condition.

Figure 8:
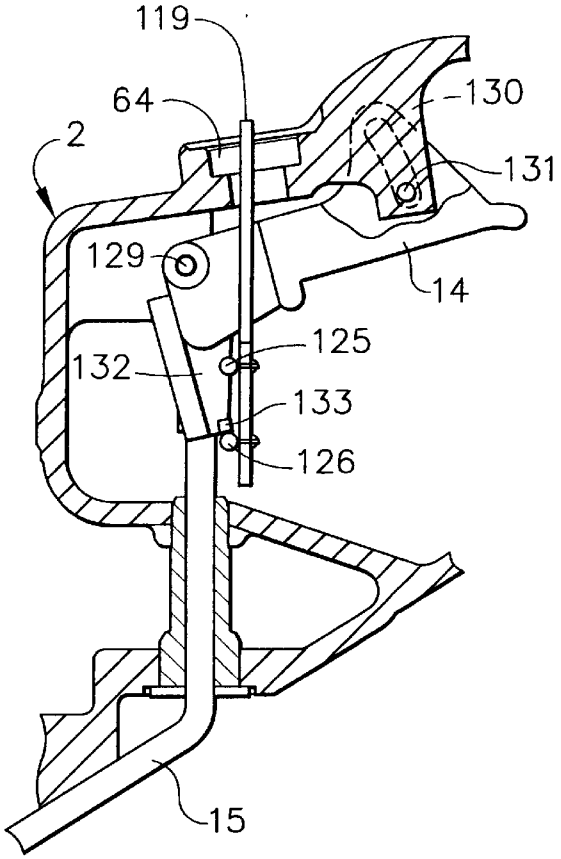
FIG. 8 is a simplified representation, similar to that of FIGS. 6 and 7, illustrating the trigger and the workpiece responsive trip in their actuated positions.

FIG. 8 is similar to FIGS. 6 and 7, differing in that the trigger 14 is shown in its actuated position which is limited by pin 131 in slot 130. In FIG. 8 trigger magnet 133 is located adjacent trigger reed switch 126 which will assume its closed state. When the trigger 14 is released by the operator's finger, it too will return to its unactuated position shown in FIG. 6. The trigger is biased to its unactuated position shown in FIG. 3 by any appropriate means such as a torsion spring (not shown), as is well known in the art. When the trigger 14 returns to its normal, inactuated position, switch 126 will assume its normal open state.

As is taught in the above-noted U.S. Pat. No. 4,679,719, there could be additional switch-actuated inputs to microprocessor 120. There could be inputs, for example, indicating various conditions or states of the tool such as an empty magazine input signal to prevent dry firing, an input signal indicating that the supply of air under pressure is at too great a pressure, an input signal indicating that the air under pressure is under too little pressure, an input signal from an ambient gas sensor, an input signal from a broken tool sensor, and the like. For the most common modes of operation, the microprocessor 120 must have at least an input from manual trigger 14 via its reed switch 126 and an input from the workpiece responsive trip 15 via its reed switch 125.

In some pneumatic fastener driving tools there may not be sufficient space to laterally offset switches 25 and 126 by a sufficient amount to insure that trip magnet 128 might interfere with proper operation of switch 125 or that trigger magnet 133 might interfere with proper operation of switch 126. When this is the case one or both of reed switches may be replaced by an appropriate mechanical switch.

As indicated above, the battery 123, which is used to energize the solenoid coil assembly 89 of remote valve 55, is a rechargeable battery. To this end, the tool 1 is provided with an exhaust driven generator, generally indicated at 134. The generator 134 is of conventional construction comprising a field magnet, armature coils, a commutator and brushes, all of which are known in the art and none of which are shown in FIG. 2 for purposes of clarity. The armature coils and commutator are mounted on a shaft 135. The lower end of shaft 135 extends into shaft bearing 136 located in the cylindrical protrusion 26 of cap assembly 11. The upper end of shaft 135 is mounted in a shaft bearing indicated at 137 in FIG. 2.

The generator 134, itself, is located in an open top cylindrical chamber 138 constituting a part of plate-like closure 35. The cylindrical chamber 138 has a bottom 139 with an opening 140 formed therein, to accommodate the generator shaft 135. Generator 134 may be fixed in cylindrical chamber 138 by any appropriate means such as machine screws 141 extending through the bottom 139 of chamber 138 and threadedly engaged into the generator 134.

Generator shaft 135 has non-rotatively affixed thereto a turbine 142. Turbine 142 has a plurality of blades 143 arranged about cylindrical chamber 138 and within the chamber 27 of cap assembly 11. It will be noted that the body part 144 of turbine 142, affixed to shaft 135, is located between the shaft bearing 136 and a thrust bearing 145.

It will be remembered that, upon driving a nail into a workpiece, the main valve assembly 47 returns to its closed position opening the various vent passages for air above piston 9. As heretofore described, when the piston 9 executes its return stroke, air thereabove is vented to atmosphere through cap assembly chamber 27. As the exhaust air rushes through cap assembly chamber 27, it will cause the turbine blades 143 to rotate and the generator 134 to produce current. This current is used in the recharging of battery 123. As a result, the battery 123 gets partially recharged during each return stroke of the driver.

While any type of generator might be used in association with the tool, an air powered generator, such as generator 134 described above, is preferred because there will always be a supply of exhaust air during each tool cycle. It would also be within the scope of the present invention to locate an air powered generator in association with the port 13 of reservoir 12, the generator being actuated by incoming high pressure air from the source thereof during each tool cycle. A generator of this type is illustrated in phantom lines and simplified form at 134*a*.

As indicated above, the microprocessor 120 is preferably preprogrammed to determine the mode or modes of operation of the tool 1. As will be appreciated by one skilled in the art, there may be many modes of operation, depending upon the particular application to which the tool 1 is directed. Microprocessor 120 may be preprogrammed with any appropriate mode or modes suitable for the use to which tool 1 is directed. Previously mentioned U.S. Pat. No. 4,679,719, heretofore incorporated herein by reference, teaches a number of operational modes in detail including state diagrams and flow diagrams therefore. Briefly, the exemplary modes taught in this patent comprise a safety fire-trigger fire mode, a restrictive mode, and a sequential mode. As is taught in U.S. Pat. No. 4,679,719, all three of these modes could be modified to include an auto-fire feature, particularly the first two of the above-mentioned modes.

As is set forth in U.S. Pat. No. 4,679,719, the safety fire-trigger fire mode is one in which all that is required is that both the trigger and the safety be actuated. They may be actuated in any order. Once both are actuated, the tool will cycle. Either one of the trigger and safety may be deactuated and reactuated to obtain another cycle. The second mode of operation, the restrictive mode, requires that the safety must always be actuated first, followed by the trigger. Whenever the safety is deactivated, the trigger must also be deactivated and the sequence started over. However, as long as the safety is activated, the trigger can be activated any number of times for repetitive cycles.

The sequential mode is one in which the safety must be activated first and then the trigger to cycle the tool. Both the safety and the trigger must be deactivated before this sequence can start again. The modes just described are three basic, exemplary modes. The microprocessor may be preprogrammed with one or more modes such as these, or variations thereof. As indicated before, an auto-fire feature can be added, particularly to modes such the safety fire-trigger fire mode and the restrictive mode.

The microprocessor may be so preprogrammed that the tool is capable of operating in only one predetermined mode. Alternatively, the microprocessor may be preprogrammed to provide two or more modes. When this is the case, the tool may be provided with a mode selector switch (shown at 121 in FIG. 5) having a number of positions equivalent to the number of modes provided by the microprocessor.

It is within the scope of the invention to locate selector switch 121 wholly within the electronics package 111, so that it would be required to remove the unit comprising the back 118 and sides 113 and 114 of the electronics package to change the position of switch 121.

An advantage of the electronic control system lies in the fact that the microprocessor can be preprogrammed with various timing features, depending upon the particular mode of operation being used. For example, the time between firings in an auto-fire sequence can be preprogrammed in the microprocessor. In some circumstances it may be desirable to provide a trigger timer which disables the trigger if the safety is not actuated within a preprogrammed time limit. A trip timer may be provided to disable the tool if the trip is actuated for a time greater than a preprogrammed limit, independent of the trigger, to preclude wire up to disable the trip.

A short time delay sequence may be utilized to prevent double-cycling. Particularly with more powerful fastener driving tool, the driving of a fastener may result in a slight bouncing of the tool resulting in inadvertent deactivation and reactivation of the trigger, or the safety trip, or both, resulting in a second unwanted cycling of the tool. To prevent this, the microprocessor may be preprogrammed to provide a short time delay after a cycle within which the microprocessor will not accept inputs from the either trigger or the safety. This would preclude double-cycling. The microprocessor 120 initiates the short delay at the time the solenoid of the remote valve is actuated.

An exemplary tool was made in accordance with the teachings of the present invention and the microprocessor 120 was preprogrammed with two modes of operation selectable by mode selector switch 121. The first mode is equivalent to the sequential mode described in U.S. Pat. No. 4,679,719. In this mode, the safety 15 must be actuated first, followed by actuation of trigger 14 to cycle the tool. Both the safety 15 and the trigger 14 must be deactuated before the sequence can start again. The second mode of operation is similar to the safety fire-trigger fire mode described in U.S. Pat. No. 4,679,719 in that both the trigger 14 and the safety 18 must be actuated to cycle the tool, but they can be actuated in any order. Once both are actuated, the tool will cycle. Further, after the driving of the first fastener, the trigger 14 can be held in its actuated position, and the tool can be fired by deactuating and reactuating the safety 15. Unlike the safety fire-trigger fire mode described in U.S. Pat. No. 4,679,719 the safety 15 cannot be maintained in actuated position and the tool repeatedly fired by trigger 14.

Figure 9:
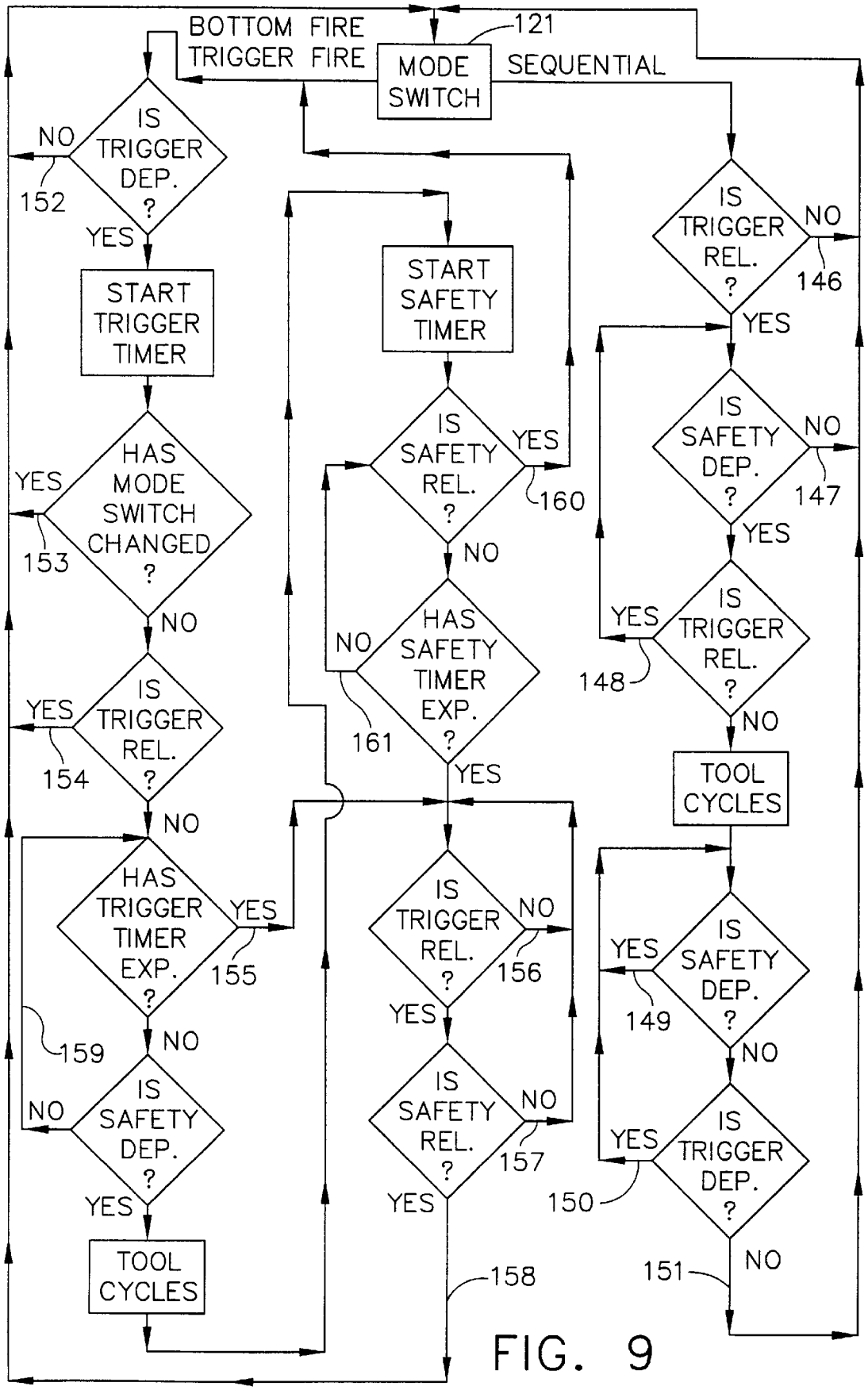
FIG. 9 is a flow diagram for an exemplary dual mode tool.

Reference is made to FIG. 9 wherein a flow diagram is presented for the microprocessor 120 of the exemplary tool being described.

When the mode switch 121 is set for the sequential mode, the circuit will loop as at 146, rechecking the mode switch position, if the trigger 14 is not released. If the trigger 14 is released, the circuit will next check to see if the safety 15 is depressed. If the safety 15 is not depressed, the circuit will loop as at 147, again checking the position of the mode selector switch 121. If the safety 15 is depressed, the circuit will see if the trigger 14 is released. If the trigger 14 is released, the circuit will loop as at 148. If the trigger 14 is not released, the circuit will cause the tool to cycle.

After the tool has cycled in the sequential mode, the circuit will check to see if the safety 15 remains depressed. If it is depressed, the circuit will loop as at 149 until the safety 15 is released. When the safety 15 is released, the circuit will ascertain whether the trigger 14 remains depressed. If the trigger 14 is depressed, the circuit will loop as at 150. If the trigger 14 is released, the circuit will loop as at 151, again checking the mode switch 121. If the mode switch 121 has not been shifted to the bottom fire-trigger fire mode, the circuit stands ready to repeat the sequential mode. From this description it will be seen that in the sequential mode the safety 15 must be actuated first, followed by actuation of trigger 14, whereupon the tool will cycle. The circuit will not be ready to repeat the sequential mode until both the safety 15 and the trigger 14 are released to their unactuated positions.

When the mode switch 121 is set for the bottom fire-trigger fire mode of the exemplary tool being described, the circuit will loop as at 152, rechecking the mode switch position, if the trigger 14 is not depressed. If the trigger 14 is depressed, the trigger timer will be initiated, limiting the time within which the safety 15 must be actuated. Any appropriate time limit may be programmed into microprocessor 120. For example, a four second time limit has been found suitable. The circuit will next check to see if the mode switch 121 has changed, if the answer is yes, the circuit will loop as at 153 to recheck the mode switch 121 and to initiate the sequential mode. If the mode switch 121 has not changed, the circuit will check to see if the trigger 14 has been released. If it has, the circuit will loop as at 154, checking the mode switch 121 and reinitiating the bottom fire-trigger fire mode. If the trigger 14 has not been released, the circuit will check to see if the trigger timer has expired. If the answer is yes, the circuit will cycle as at 155 to its steps to end the mode sequence. The circuit will check to see if the trigger 14 has been released. If not, the circuit will loop as at 156 until the trigger 14 is released. Once the trigger 14 is released, the circuit will see if the safety 15 has been released. If not, it will loop as at 157. If the safety 15 has been released, the circuit will recycle as at 158 to check the mode switch 121 and to be ready to reinitiate the bottom fire-trigger fire mode. If it had been discovered that the trigger timer had not expired, the circuit will not cycle as at 155, but rather the circuit will see if the safety 15 has been depressed. If the safety has not been depressed, the circuit will cycle as at 159, performing the same series of steps described with respect to cycle 155. If the safety 15 is depressed, the tool will cycle, driving a fastener into the workpiece. Once the tool has been cycled, the circuit will initiate the safety trip timer. Again, the safety trip timer can be preprogrammed in the microprocessor 120 having any desired duration. Excellent results have been achieved with a seven second time delay. Thereafter, the circuit determines whether the safety 15 is released. If it is, the circuit cycles as at 160 to the beginning of the bottom fire-trigger fire mode. As a consequence of this, if the safety trip timer has not expired before the safety is released, and if the trigger is maintained actuated, the tool will cycle if the safety is again depressed within the trigger time limit. Thus, with the trigger maintained in its actuated position, if conditions are met before the trigger timer limit and the safety timer limit expire, the tool will bottom fire by simply repetitively actuating, releasing and reactuating the safety 15. If, at the end of a tool cycle, the safety 15 is not released, the tool will loop as at 161 until the safety timer expires. When this happens, the circuit will look to see if the trigger 14 is released. If not, it will continue to loop as at 156 until the trigger is released. It will then see if the safety is released. If not, it will loop as at 157 until the safety is released. Once the safety is released, the circuit will loop as at 158 to check the mode switch 121 and to reinitiate the bottom fire-trigger fire mode if the mode switch 121 remains in that mode.

It will further be evident from the diagram just described that, in the bottom fire-trigger fire mode, if the safety 15 has been wired in such a way as to remain in its actuated position, the tool will fire once. Thereafter, it will not repeat the cycle, nor will it bottom fire, until the safety is returned to its unactuated position. It is evident from the above description that the tool will not function in the sequential mode after the first fastener is driven into the workpiece, until the safety 15 is released to its unactuated position.

It is within the scope of the invention to program microprocessor 120 in such a way as to provide both a bottom fire-trigger fire mode and a sequential mode, similar to those illustrated in FIG. 9, but not requiring the presence of a selector switch, such as selector switch 121 of FIG. 5. In this instance, the operator selects the mode of operation at the beginning of a tool cycle by choosing which of the manual trigger 14 and the safety trip 15 he actuates first. A flow chart illustrating this is provided in FIG. 10. As is apparent from the flow chart of FIG. 10, if neither one of the manual trigger 14 and the safety trip 15 is depressed, the circuit will simply loop until one or the other is depressed. In a situation where the trigger is not depressed and the safety trip is depressed, the circuit will be in the sequential mode. In other words, if the trigger is not depressed and the safety is depressed, the circuit will shift to the right hand portion of the flow chart which is substantially identical to the sequential mode illustrated in FIG. 9. The circuit will check again to see if the trigger is released, if the answer is no, it will loop back to the beginning as at 162. If the trigger is released, the circuit will check to see if the safety remains depressed. If the answer is no, the circuit will loop as at 163 back to the beginning. If the answer is yes, the circuit will check again to see if the trigger remains released. If the answer is yes, the circle will loop as at 164 until the trigger is depressed, the circuit remaining in the sequential mode. When the trigger is indeed depressed, the tool cycles. It will be noted that in the step just before tool cycling, if the trigger remains released, the circuit could loop as shown in broken lines at 165. This would enable elimination of the third and fourth question steps. In other words, following the initial two question steps (Is the trigger depressed? and Is the safety depressed?) the circuit could drop immediately to the question step (Is the trigger released?) just before cycling of the tool and the result would be the same. The circuit as drawn in full lines is preferred simply because the additional third and fourth steps (Is the trigger released? and Is the safety depressed?) act as an additional safety check.

Once the tool has cycled, the circuit will inquire if the safety is depressed. If the safety remains depressed, the circuit will loop as at 166 until the safety is released. When the safety is released, the circuit will inquire as to whether the trigger is depressed. If the trigger remains depressed, the circuit will loop as at 167 until the trigger is released. Upon release of the trigger, the circuit will cycle back to the beginning. If the operator depresses the safety trip before he depresses the manual trigger, the tool will once again be in sequential mode.

If, at the outset, the operator first depresses the trigger, he will immediately start the trigger timer and the tool will be in the bottom fire-trigger fire mode. The circuit will thereafter inquire if the trigger has been released. If it has, the circuit will cycle as at 168 to the beginning. If the trigger has not been released, the circuit will check to see whether the trigger timer has expired. If it has expired, the circuit will cycle as at 169 and will next check to see if the trigger is released. If the trigger remains depressed, the circuit will simply loop as as at 170 until the trigger is released. If the trigger is released, the circuit will check to see if the safety is released. If the safety is not released, the circuit will loop as at 171 until the safety is released. If the safety is released, the circuit will cycle back to the beginning, as at 172.

If the above-mentioned check to see if the trigger timer had expired had shown that it had not done so, the circuit would thereafter check to see if the safety was depressed. If the answer is no, the circuit would again as at 173 following the same steps as loop 169 and ending in cycle 172 to the beginning of the circuit. If it had been found that the safety was depressed, the tool will cycle. This, in turn, will start the safety timer, the circuit will then check to see if the safety has been released. If it has, the circuit will cycle as at 174 to the beginning of the circuit. As a consequence of this, if the safety timer has not expired before the safety is released, and if the trigger is maintained actuated, the tool will cycle if the safety is again depressed within the trigger time limit. Thus, with the trigger maintained in its actuated position, if conditions are met before the trigger time limit and the safety trip timer limit, the tool will bottom fire by simply repetitively actuating, releasing and reactuating the safety.

If at the end of the tool cycle the safety is not released, the tool will loop as at 175 until the safety timer expires. Thereafter, the circuit will check to see if the trigger is released. If not, the circuit will loop as at 170 until the trigger is released. The circuit will then make a final check to see if the safety is released. If not, the circuit will loop as at 171 until both the trigger and the safety trip have been released. Thereafter, the circuit will cycle back to the beginning.

Figure 10:
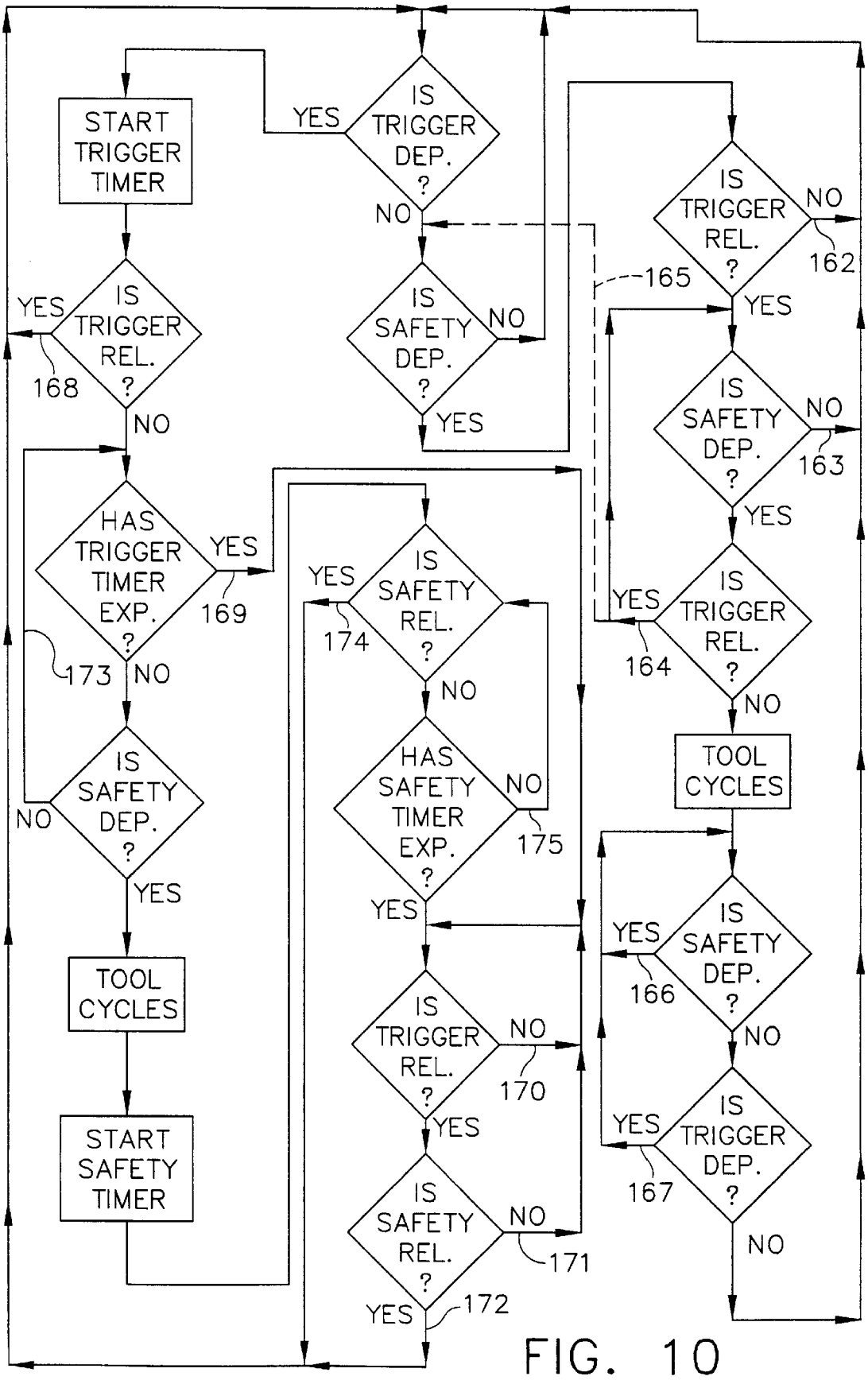
FIG. 10 is a flow diagram for another exemplary dual mode tool.

The similarities of the flow charts of FIGS. 9 and 10 will be appreciated. In essence, the mode switch 121 of FIG. 9 has been replaced by the central two steps (Is the trigger depressed? and Is the safety depressed?) of FIG. 10.

It will be understood by one skilled in the art that the microprocessor 120 could have just a single input. For example, a electrically controlled pneumatic fastener driving tool may not be provided with a safety trip. In such an instance, the modes of operation of such a tool would differ. Nevertheless, the principles of the present invention could be applied to such a tool substantially in the manner described above.

The invention having been described in detail, it is important to note that words employed herein and in the claims, such as "vertical", "horizontal", "upper", "lower", "uppermost" and "lowermost", are used in conjunction with the drawings for purposes of clarity. It will be understood by one skilled in the art that the tool described herein may be held in many different orientations during use.

Modifications may be made in the invention without departing from the spirit of it.

There are many types of fastener driving tools in which the driver is actuated by other than pneumatic means. For example there are fastener driving tools in which the driver is actuated by internal combustion means, solenoid means, fly wheel means, propellant means, and the like.

It will be understood by one skilled in the art that many of the teachings of the present invention can be applied to non-pneumatic fastener driving tools. This is true, for example, of the use of a time delay to prevent double cycling, the location of an electronics control package in direct association with the fastener driving tool, the use of a reed switch in association with one or both of a manual trigger and a safety trip, the use of an electronics control employing a microprocessor preogrammed to provide one or more modes of operation, the use of a microprocessor programmed to provide two modes of operation and to enable the operator to choose the mode he wishes by the order in which he actuates various instrumentalities of the tool, the use of a gas operated generator in an internal combustion tool to recharge the battery operating the ignition means, and the like.

What is claimed:

1. An electronically controlled pneumatic fastener driving tool of the type having a main tool-cycling valve, at least one of a manual trigger and a workpiece responsive safety trip, an electronic control comprising a solenoid actuated remote valve associated with said main valve in such a way as to actuate said main valve when said remote valve is actuated by said solenoid, said electronic control further comprising a microprocessor, said microprocessor being programmed to provide at least one mode of operation for said tool, said microprocessor having at least one input from said at least one of said safety trip and said trigger and an output to energize said remote valve solenoid when said at least one input, satisfies said at least one mode, a battery to energize said solenoid, said battery comprising a rechargeable battery, a generator comprising a part of said tool, said generator being actuable during each cycle of said tool to partially charge said battery.

2. The fastener driving tool claimed in claim 1 wherein said tool has an exhaust system, said generator comprising an air driven generator having an actuating shaft and a turbine blade assembly affixed to said shaft, said turbine blade assembly being located in said exhaust system for driving said generator during a portion of each tool cycle, said generator having an electrical power output connected to said battery to partially recharge said battery during each tool cycle.

3. The fastener driving tool claimed in claim 1 wherein said tool has a reservoir with a port connectable to a source of air under pressure, said generator comprising a turbogenerator associated with said port so as to be actuated by incoming replacement high pressure air during a portion of each tool cycle, said generator having an electrical power output connected to said battery to partially recharge said battery each tool cycle.

* * * * *